US005307617A

United States Patent [19]

Karhu

[11] Patent Number: 5,307,617

[45] Date of Patent: May 3, 1994

[54] REVERSE STRANDING APPARATUS WITH TWISTABLE PERIPHERAL TUBES ATTACHED TO A CENTRAL ELEMENT

[75] Inventor: Raimo Karhu, Helsinki, Finland

[73] Assignee: Nokia-Maillefer Holding S.A., Ecublens, Switzerland

[21] Appl. No.: 929,913

[22] Filed: Aug. 17, 1992

[30] Foreign Application Priority Data

Aug. 28, 1991 [FI] Finland ..... 914066

[51] Int. Cl.[5] ..... H01B 13/02

[52] U.S. Cl. ..... 57/293; 57/204; 57/294; 57/352

[58] Field of Search ..... 57/293, 294, 352, 204

[56] References Cited

U.S. PATENT DOCUMENTS 3,847,190 11/1974 Forester ..... 57/293 X
4,151,704 5/1979 Spicer et al. ..... 57/13
4,414,802 11/1983 Garner et al. ..... 57/293
4,426,839 1/1984 Garner et al. ..... 57/293
4,590,755 5/1986 Garner et al. ..... 57/293
4,615,168 10/1986 Oestreich ..... 57/293 X
4,974,408 12/1990 Karhu ..... 57/314 X

*Primary Examiner*—Daniel P. Stodola
*Assistant Examiner*—William Stryjewski
*Attorney, Agent, or Firm*—Nixon & Vanderhye

[57] ABSTRACT

A reverse stranding apparatus for the reverse stranding of conductors. The apparatus comprises a stationary divider plate, a twisting plate rotatable in different directions, and a central element disposed between the parts, and peripheral tubes surrounding the central element, the central element and the peripheral tubes being pressed against each other at least during the twisting step of the conductors, and the conductors to be stranded being adapted to pass through at least the peripheral tubes. To allow high speeds of rotation, the peripheral tubes are connected substantially for their entire length to the central element by a substantially radial part.

9 Claims, 1 Drawing Sheet

REVERSE STRANDING APPARATUS WITH TWISTABLE PERIPHERAL TUBES ATTACHED TO A CENTRAL ELEMENT

BACKGROUND OF THE INVENTION

A reverse stranding apparatus for the reverse stranding of conductors, such as filaments, conductor elements, bundles of conductors, optical fibres and similar for the manufacturing of cables or the like, comprising a stationary divider means disposed at the upstream end for the conductors to be stranded, a twisting means rotatable in different directions and disposed at the downstream end for the conductors to be stranded, and a medially disposed central element rotatable recurrently about its longitudinal axis in opposite directions and peripheral tubes being twistable recurrently in opposite directions and peripherally surrounding the central element, the central element and the peripheral tubes being disposed between the divider means and the twisting means and being pressed against each other at least during the twisting step of the conductors and the conductors to be stranded being adapted to pass through at least the peripheral tubes.

A wide variety of apparatus as presented above are known for instance in the cable industry. The apparatus disclosed in U.S. Pat. No. 4 974 408 may be mentioned as an example of prior art apparatus in this field. The apparatus disclosed in said U.S. Patent operates completely faultlessly in most circumstances. However, in some circumstances the operation is not the best possible. For example, it has been found in practice that with high speeds of rotation of a tube packet, centrifugal force will produce outward radial displacement of the peripheral tubes on the unbound portions thereof. In the above known solution, the peripheral tubes are bound by means of spaced elastic rings, the compression force of which acts only on a specific longitudinal area of the tubes. The axial spanning force on the tube packet and the relative distance of the elastic rings together define the maximum speed of rotation. Exceeding said speed will have the result that the outer peripheral tubes bulging outwards under the influence of centrifugal force displace the elastic rings in the axial direction, and thus with this mechanism the disruption will be self-augmenting. Also the central tube has a tendency to come out from between the peripheral tubes, if it has been stretched more than the outer peripheral tubes. Another problem is presented by creep, which is due to the properties of the plastics used as the tube material. This creep is very intense at the initial stage of putting into use the tube packet, and consequent thereon the tube packet must be shortened several times. Later said creep will diminish, but it will not cease. On account of the creep, the maximum length of the tube packet is limited, which again limits the maximum relative distance of the reversing points. A third problem worth mentioning is that the desired axial spanning force cannot be used owing to the material employed. This fact is reflected in sagging of the tube packet, which in turn will produce undesired whirling. It is known from experience that a large sag of the tube packet will increase the friction coefficient between the tube and the conductor. The plastics that are most suitable for use as tube materials typically have high friction coefficients and poor mechanical strength values. In the prior solutions, specifically the friction coefficient between the tube and the conductor is the most significant factor affecting the number of upturns in the same direction which is obtained. The intent is to achieve a maximum number of upturns in the same direction, as by this means the reversing points can be disposed far from one another, and this again improves the electrical characteristics of a telecommunications cable.

It is the object of the present invention to provide a reverse stranding apparatus wherewith the drawbacks of the prior art can be eliminated. This has been achieved with the reverse stranding apparatus of the invention, which is characterized in that the peripheral tubes are connected substantially for their entire length to the central element by means of a substantially radial part.

The advantage of the invention lies above all in that the radial connection of the tubes to the central element allows remarkably high speeds of rotation for the rotating head/tube packet. Very high grouping and stranding speeds are possible even with small upturn values. Generally speaking, it can be said that due to the invention, the tube packet will no longer limit the speed of rotation, but the limiting factor is constituted by the motor. The construction of the tube packet in accordance with the invention is safer and more durable than heretofore. At no time will the central element be able to push out from between the peripheral tubes. In the construction according to the invention, the tube packet will retain its initial longitudinal dimension for its entire service life. The axial spanning force on the tube packet can be increased many fold, thus permitting effective prevention of whirling. A smaller friction than heretofore is achieved between the tube and the conductor, since it is known from experience that the smaller the sag, the lower the friction. Thus, the length of the tube packet will not constitute a restricting factor. A further advantage is that by means of the invention, different and continuously varying run profiles of speed of rotation for the rotating head can be employed without any restrictions. The rotating head and the tube packet typically display very high speeds of rotation, continuously changing direction. A small friction between the tube and the conductor will add to the windings of the tube packet in the same direction. A better quality than heretofore is achieved for sophisticated cables. The grouping or stranding procedures do not induce any forces acting adversely on the conductor or any deformation that would stretch the conductor, for instance.

BRIEF DESCRIPTION OF THE DRAWING FIGURES

The invention will be explained in more detail in the following by means of preferred embodiments described in the accompanying drawing, wherein FIG. 1 is a schematic elevational view of a reverse stranding apparatus of the invention, FIG. 2 is an axial view of a tube packet used in the apparatus of FIG. 1, and FIGS. 3 to 6 are axial views of alternative tube packets in the apparatus of the invention.

DESCRIPTION OF A PREFERRED EMBODIMENT

Figure 1:
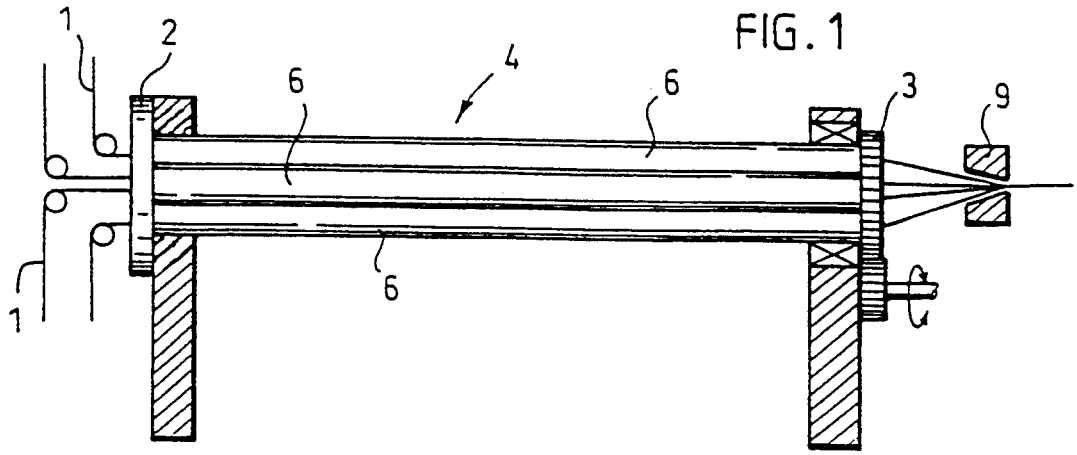

FIG. 1 is a schematic representation of a reverse stranding apparatus of the invention. In FIG. 1, the reference numeral 1 denotes the conductors to be stranded, and the reference numeral 2 denotes a stationary divider means disposed at the upstream end for the conductors 1. The reference numeral 3 in FIG. 1 denotes a twisting means disposed at the downstream end for the conductors 1 to be stranded, rotatable in different directions. The reference numeral 4 generally denotes a tube packet comprising a central element 5 and peripheral tubes 6 peripherally surrounding it. The central element 5 and the peripheral tubes 6 are pressed against each other at least during the twisting step of the conductors.

The term conductor in this context refers to filaments, conductor elements, bundles of conductors, quads, optical fibres and other similar elements. The stationary divider means 2 and the rotatable twisting means may be apertured disks, for instance.

In accordance with an essential feature of the invention, the peripheral tubes 6 are connected substantially for their entire length fixedly to the central element 5 by means of a substantially radial part. This construction is particularly well apparent from FIG. 2, wherein the tube packet 4 is described in an axial view.

Figure 2:
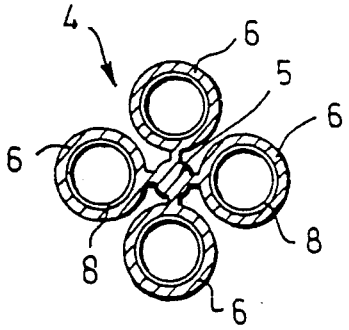
Figure 3:
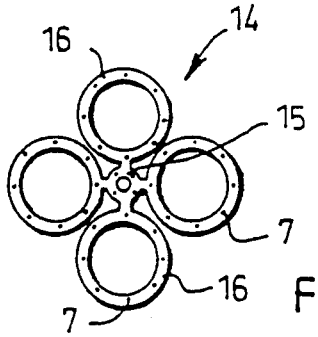
Figure 4:
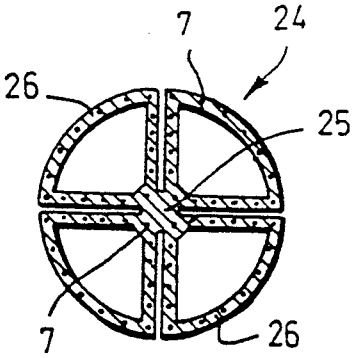
Figure 5:
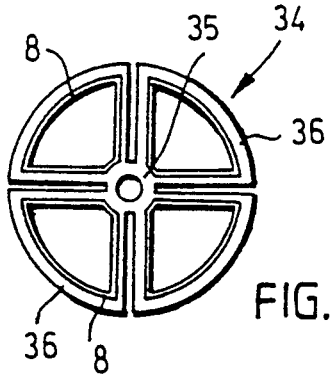
Figure 6:
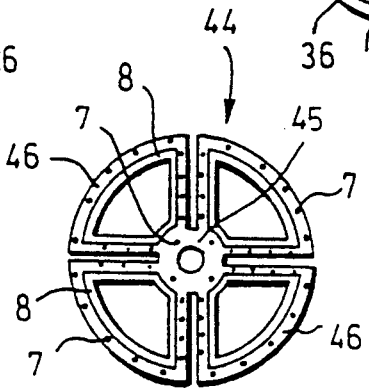

The term peripheral tube is to be understood very broadly in this context, that is, the term is not solely restricted to a tube having a circular cross-section, but other shapes are possible as well. FIGS. 3 to 6 disclose various possible alternatives for tube packets. In FIG. 3, a tube packet is generally indicated by the reference numeral 14, the central element by the reference numeral 15 and the peripheral tubes by the reference numeral 16. In FIG. 4, the tube packet is generally indicated by the reference numeral 24, the central element by the reference numeral 25 and the peripheral tubes by the reference numeral 26. In FIG. 5, the tube packet is generally indicated by the reference numeral 34, the central element by the reference numeral 35 and the peripheral tubes by the reference numeral 36. In FIG. 6, the tube packet is generally indicated by the reference numeral 44, the central element by the reference numeral 45 and the peripheral tubes by the reference numeral 46. In the embodiments of FIGS. 4 to 6, the cross-section of the peripheral tubes has substantially the shape of a circular sector. In each embodiment, the peripheral tubes are fixedly attached by means of radial necks to the central element. The adjacent sides of the peripheral tubes are detached from one another in all embodiments, and this allows twisting and relative movement of the tubes. At the same time, the torque required to twist the tube packet will not be excessively high even with large-sized tube packets. It should be noted that the number of peripheral tubes has not been limited to four as shown in the figures, but the number of the peripheral tubes can be selected according to current need. The central element may also be a tube or a hollow construction; for instance in the embodiment of FIG. 2, the central element is a hollow and in the embodiment of FIG. 3 a tube, respectively.

Filaments or fibres may be fitted to the central element and/or the walls of the peripheral tubes during the manufacture. The filaments or fibres are indicated by the reference numeral 7 in the figures. The filaments or fibres may be straight, i.e. axial, wound in opposite upturn directions, or have a reticular pattern. The purpose of the filaments or fibres is to take up axial loads and to prevent creep of the tube packet. The filaments or fibres also have an effect on the whirling referred to previously, since the greater the force with which the tube packet can be spanned in the axial direction, the more effectively whirling is prevented. The discrete filaments or fibres may be for instance carbon, aramide, boron or steel fibres. The central element and the peripheral tubes may employ the same fibres or filaments. The central element may further incorporate a bar, a wire cable, etc.

Another possibility is to use fibre-reinforced plastic material in the manufacture of the tube packet.

The tubes in the packet may also be manufactured from two different materials, that is, the outer surface from a material having a good mechanical strength and the inner surface from a material having a very low friction. This permits the friction between the conductors and the inner surfaces of the peripheral tubes to be minimized, thus producing cables of a higher quality. Tube packets constructed from two different materials are shown in FIGS. 2, 5 and 6. In these figures, the low-friction material is indicated by the reference numeral 8. This material may be PTFE, for instance, which as such does not provide a suitable material for the tube packet on account of its poor mechanical properties. The other material may be for instance PA plastic. It is naturally also possible to use more than two different materials for the manufacture of the tube packet.

When a reverse-stranded product is manufactured with the apparatus of FIG. 1, the conductors 1 to be stranded are drawn through the divider means 2 into the peripheral tubes and further through the rotatable twisting means 3 out for instance into a nozzle 9 disposed downstream of the twisting means in the running direction of the conductors, the nozzle having a tapering opening wherein the stranded conductors are pressed tightly against one another, thus forming a reverse-stranded product. The nozzle 9 is not an indispensable detail. The completed product may, if desired, additionally be bound to prevent untwisting. Any conventional spinning device or other similar apparatus may be used for the binding. The twisting means 3 is fitted with a rotatable drive of its own, preferably with a chain gear, gear transmission, or cogged belt driven electric motor whose speed of rotation can be regulated and reversing automation realized fairly simply. The general features as presented above relating to the operation and use of the reverse stranding apparatus, i.e. the drawing of the conductors, rotating of the tube packet, further processing of the product etc., are conventional to one skilled in the art, wherefore these features are not more closely described in this connection. In addition to the above features, U.S. Pat. No. 4 974 408 referred to previously in the context of such matters is incorporated herein by reference.

The embodiments set forth above are in no way intended to restrict the invention, but the invention may be modified fully freely within the scope of the claims. Thus it is to be understood that the apparatus of the invention or its details need not necessarily be exactly as shown in the figures, but other solutions are possible as well. For instance, the cross-sectional shape of the peripheral tubes and the number of peripheral tubes has by no means been restricted to the embodiments shown in the figures, but such details may be modified freely in accordance with the current need.

I claim:

1. A reverse stranding apparatus for the reverse stranding of conductors for the manufacture of cables comprising:

a stationary divider means disposed at an upstream end of the reverse stranding apparatus for receiving the conductors to be stranded;

a twisting means rotatable in different directions and disposed at a downstream end of the reverse stranding apparatus for receiving the conductors;

an elongated central element rotatable recurrently about a longitudinal axis in opposite rotational directions; and elongated, discrete, circumferentially spaced, peripheral tubes twistable recurrently in opposite directions and peripherally surrounding said central element, said central element and said peripheral tubes being disposed between said divider means and said twisting means, the conductors to be stranded being adapted to pass through at least said peripheral tubes;

each of said peripheral tubes being integrally connected substantially throughout its entire length to said central element by a substantially radially extending part interconnecting said central element and said peripheral tube with each tube being detached from circumferentially adjacent tubes.

2. A reverse stranding apparatus as in claim 1 including reinforcing filaments disposed in said central element and extending generally in the direction of its elongation.

3. A reverse stranding apparatus as in claim 1 including reinforcing filaments disposed in said tubes and extending generally in the direction of their elongation.

4. A reverse stranding apparatus as in claim 1 including reinforcing filaments disposed in said central element and extending generally in the direction of its elongation, and reinforcing filaments disposed in said tubes and extending generally in the direction of their elongation.

5. A reverse stranding apparatus as in claim 1 wherein the central element is formed of a fiber-reinforced plastic material.

6. A reverse stranding apparatus as in claim 1 wherein said peripheral tubes are formed of a fiber-reinforced plastic material.

7. A reverse stranding apparatus as in claim 1 wherein the central element is formed of a fiber-reinforced plastic material, said peripheral tubes being formed of a fiber-reinforced plastic material.

8. A reverse stranding apparatus as in claim 1 wherein at least one of said peripheral tubes is formed of at least two different materials such that an outer surface of said one tube comprises a mechanically strong material and an inner material of said one tube comprises a low-friction elastic material.

9. A reverse stranding apparatus as in claim 1 wherein said peripheral tubes are connected solely to said central element.

* * * * *